US007364434B2

(12) United States Patent
Hu et al.

(10) Patent No.: US 7,364,434 B2
(45) Date of Patent: Apr. 29, 2008

(54) ELECTRICAL CONNECTOR WITH IMPROVED TERMINAL

(75) Inventors: Jin-Kui Hu, Kunshan (CN); Guo-Hua Zhang, Kunshan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 56 days.

(21) Appl. No.: 11/413,695

(22) Filed: Apr. 28, 2006

(65) Prior Publication Data

US 2006/0246746 A1 Nov. 2, 2006

(30) Foreign Application Priority Data

Apr. 28, 2005 (CN) ..... 2005 2 0071491 U

(51) Int. Cl.
*H01R 12/00* (2006.01)

(52) U.S. Cl. ..... 439/66; 439/862

(58) Field of Classification Search ..... 439/66, 439/68–73, 700, 862, 861
See application file for complete search history.

(56) References Cited

U.S. PATENT DOCUMENTS

| | | | | |
|---|---|---|---|---|
| 4,175,821 | A * | 11/1979 | Hunter | 439/856 |
| 5,286,208 | A * | 2/1994 | Matsuoka | 439/72 |
| 6,402,567 | B1 * | 6/2002 | Zhu | 439/700 |
| 6,685,486 | B1 * | 2/2004 | Zhang et al. | 439/79 |
| 6,688,893 | B1 | 2/2004 | Huang et al. | |
| 6,811,420 | B2 * | 11/2004 | Miura | 439/266 |
| 6,976,851 | B2 * | 12/2005 | Huang | 439/66 |
| 7,247,062 | B1 * | 7/2007 | Polnyi | 439/862 |
| 2005/0064766 | A1 * | 3/2005 | Zhang et al. | 439/700 |
| 2006/0246746 | A1 * | 11/2006 | Hu et al. | 439/66 |

* cited by examiner

*Primary Examiner*—James Harvey
(74) *Attorney, Agent, or Firm*—Wei Te Chung

(57) ABSTRACT

An electrical connector (1) includes an isulative housing (10) defining therein a number of passageways (114) and a number of electrical terminals (20) retained in the passageways. Each electrical terminal includes a contact portion (21), a body portion (24), a tail portion (25) extending downwardly from the body portion and a pair of wave-shaped resilient portions (23) extending between the contact portion and the body portion.

17 Claims, 3 Drawing Sheets

ELECTRICAL CONNECTOR WITH IMPROVED TERMINAL

BACKGROUND OF THE INVENTION

1. Field of the Invention

The present invention relates to an electrical connector, and particularly to an electrical connector mounted to a circuit board for use in a printer or the likes.

2. Description of Related Art

A conventional electrical connector having high performance contacts described in U.S. Pat. No. 6,688,893 comprises an insulative housing having a plurality of passageways defined therein and a plurality of terminals correspondingly retained in the passageways. Each terminal comprises a base portion interferentially retained in the insulative housing, a solder portion extending from an end of the base portion, a contact portion and an U-shaped resilient portion extending from one side of the contact portion and connect the contact portion and base portion together for providing an resilient force toward the contact portion.

As described above, the resilient portion extends from one side of the contact portion to provide resilient force toward contact portion from one direction. Therefore, the contact portion would receive a lopsided resilient force, which may result in displacement of the contact portion when the terminal is depressed for a great number of times. Further more, the resilient portion configured as a "U" shape may result in resilience loss easily. It is better to improve mechanical performance of the terminals for avoiding displacement or resilience loss.

Hence, an improved electrical connector is required to overcome the above-mentioned disadvantages of the related art.

SUMMARY OF THE INVENTION

A primary object of the present invention is to provide an electrical connector having a plurality of improved terminals capable of being securely depressed and providing adequate resilient force.

To achieve the aforementioned object, an electrical connector comprises an isulative housing defining therein a plurality of passageways and a plurality of electrical terminals retained in the passageways. Each electrical terminal comprises a contact portion, a body portion, a tail portion extending downwardly from the body portion and a pair of resilient portions extending between the contact portion and the body portion.

Other objects, advantages and novel features of the invention will become more apparent from the following detailed description of a preferred embodiment when taken in conjunction with the accompanying drawings.

DETAILED DESCRIPTION OF THE INVENTION

Figure 1:
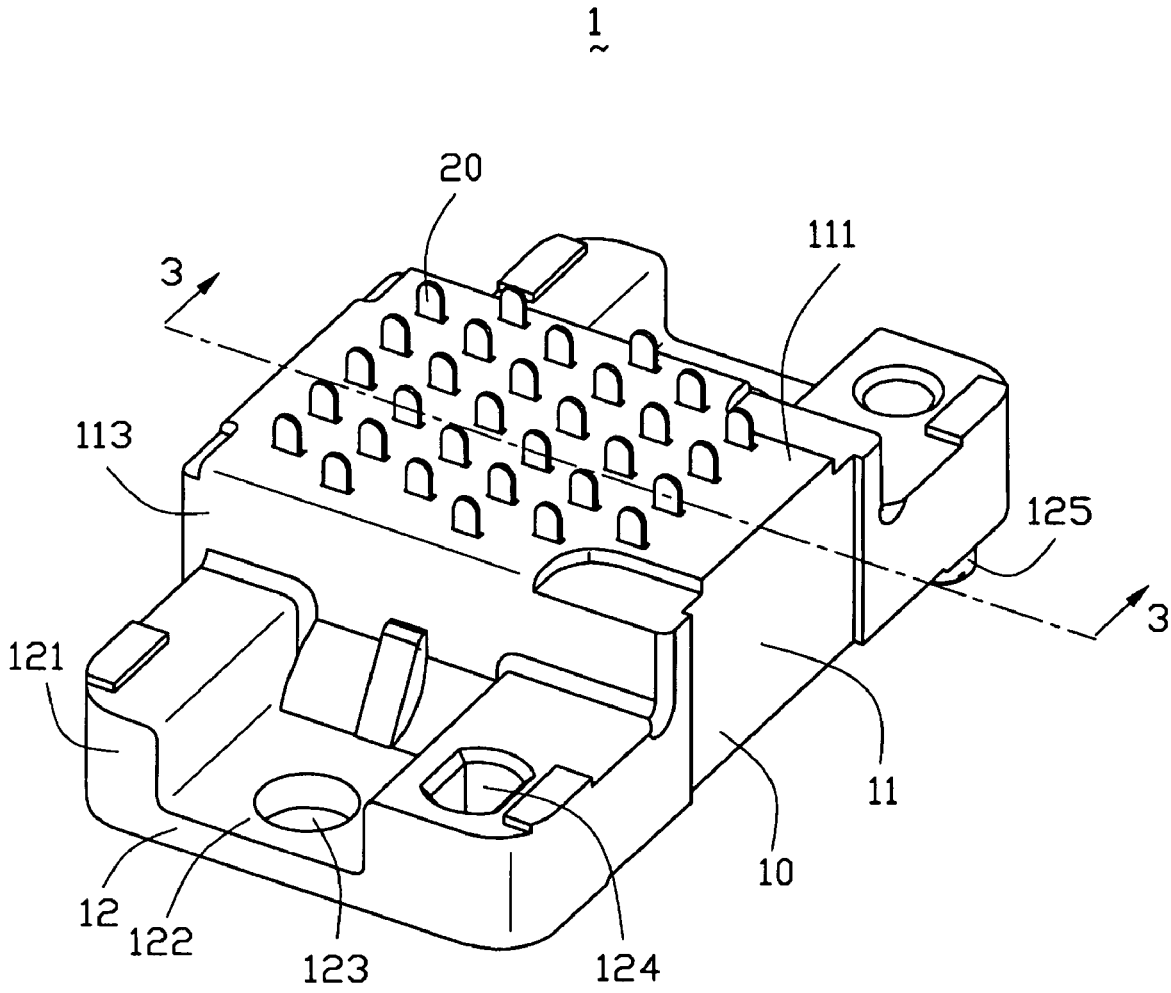
FIG. 1 is an assembled perspective view of an electrical connector in accordance with the present invention.
Figure 2:
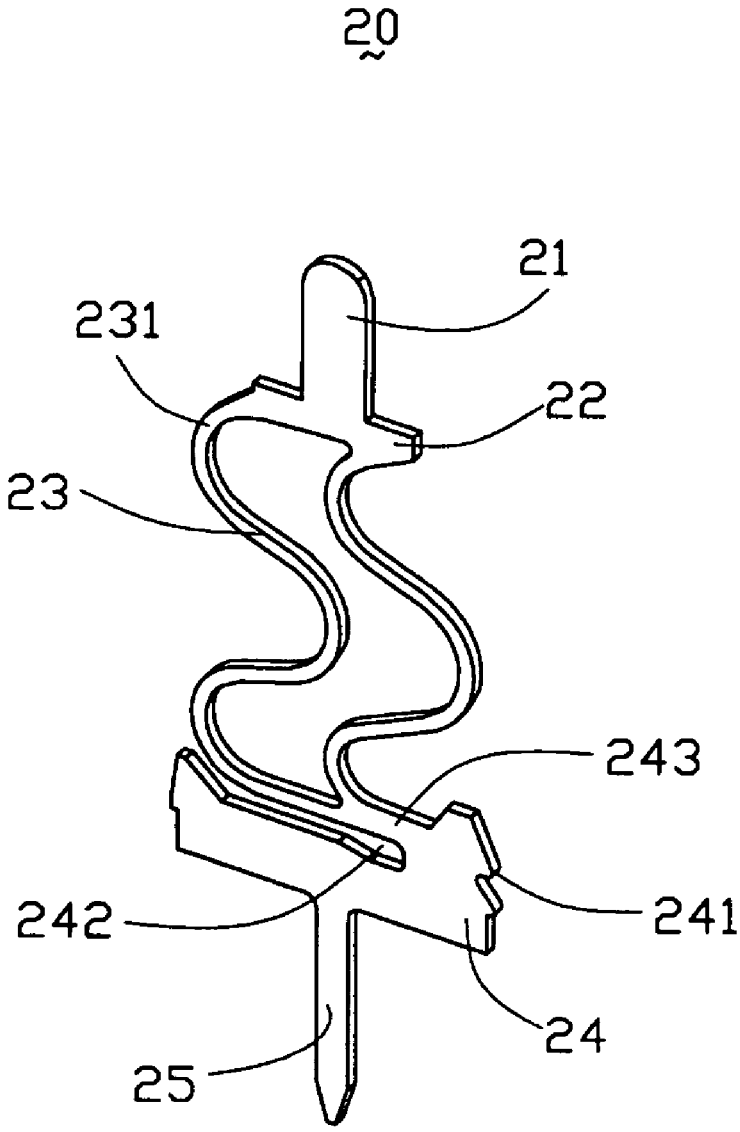
FIG. 2 is a perspective view of the electrical terminals as shown in FIG. 1.
Figure 3:
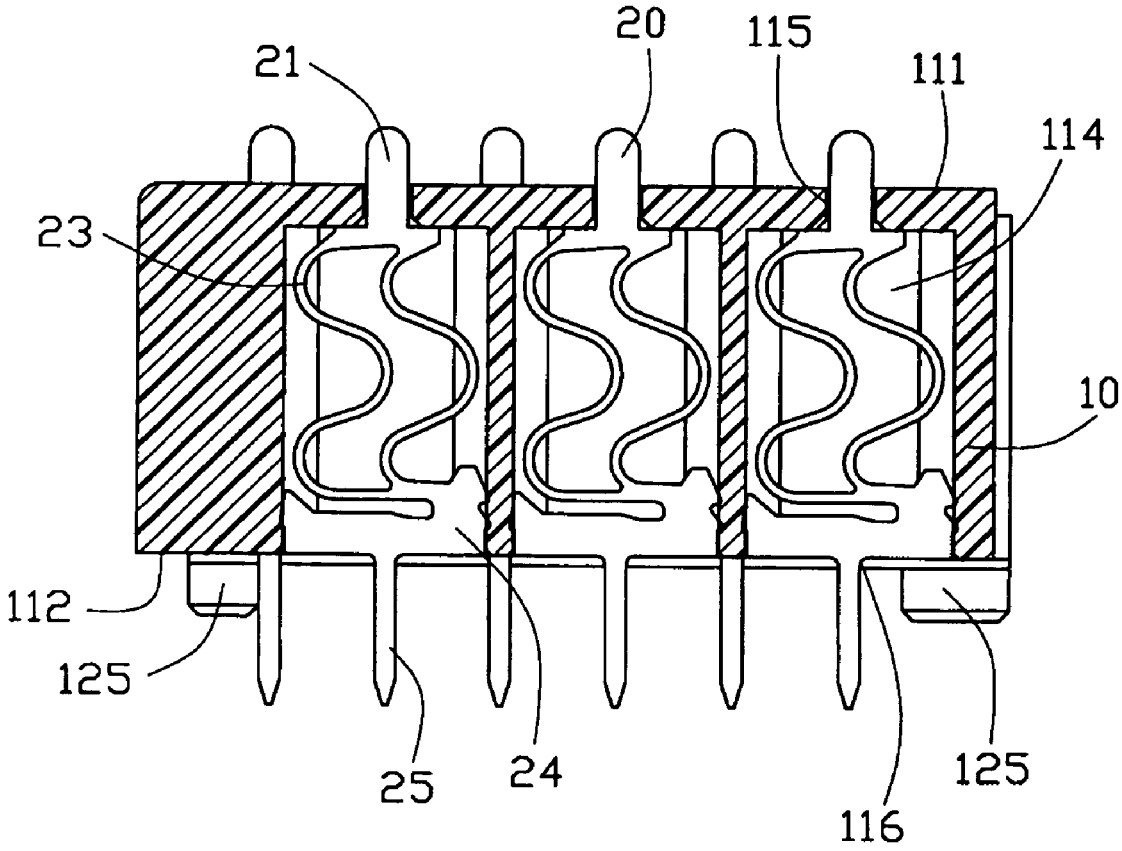
FIG. 3 is a cross-sectional view of the electrical connector as shown in FIG. 1 taken along line 3-3.

Reference will now be made to the drawing figures to describe the present invention in detail. Referring to FIGS. 1-3, an electrical connector 1 in accordance with the preferred embodiment of the present invention comprises an insulative housing 10 and a plurality of terminals 20 retained in the insulative housing 10.

Referring to FIG. 1 in conjunction with FIG. 3, the insulative housing 10 comprises a substantially rectangular base portion 11 and a pair of side portions 12 projecting symmetrically laterally from opposite sides of the base portion 11 and perpendicularly to said terminals 20. The base portion 11 has a top wall 111, a bottom wall 112 and a plurality of periphery walls 113 enclosing therearound. The base portion 11 defines therein a plurality of passageways 114 each extending in a top-to-bottom direction for correspondingly retaining the terminals 20. The top wall 111 and the bottom wall 112 respectively defines thereon a plurality of first slots 115 and second slots 116 communicating with the corresponding passageways 114 for extension of the electrical terminals 20.

Each side portion 12 has a pair of protrusions 121 and a recess 122 defined between the protrusions 121. The protrusion 121 has a mounting hole 124 corresponding with the recesses 122 defined thereon for mating with a mating connector (not shown) and a post 125 extending downwardly therefrom for supporting the hole structure. The recess 122 has an aperture 123 defined therein for mating with the mating connector.

Referring to FIG. 2, each electrical terminal 20 comprises an upwardly raising contact portion 21, a pair of shoulder portions 22 symmetrically horizontally protruding from opposite edges of the contact portion 21, a body portion 24, a tail portion 25 extending downwardly from the body portion 24 and a pair of wave-shaped resilient portions 23 extending downwardly from corresponding shoulder portions 22 and positioned between the contact portion 21 and the body portion 24. Each resilient portion 23 is formed with three continuous compressible arc-like bent portions 231. The pair of wave-shaped resilient portions 23 parallel extend along a same direction to form the continuous bent portions 231. In another embodiment, the pair of mutually separated resilient portions 23 symmetrically extend toward opposite directions to form the continuous bent portions 231. The body portion 24 defines thereon a slot 242 to form a horizontally extending connect portion 243 for connecting distal ends of the resilient portions 23. The body portion 24 has a plurality of barb portions 241 formed along a side edge thereof.

Referring to FIG. 3 in conjunction with FIG. 2, in assembly of the electrical connector 1, the electrical terminals 20 are inserted into the corresponding passageways 114, with the resilient portions 23 thereof retained in the passageways 114. The body portions 24 are fixed above the bottom wall 112, with the barb portions 241 frictionally engaging with an inner surface of the passageways 114 for firmly fixing the electrical terminals 20 to the insulative housing 10. The contact portions 21 extend outwardly through the corresponding first slots 115, with shoulder portions 22 resisting against the top wall 111. The tail portions 25 extend outwardly through the second slots 116 for soldering onto a circuit board (not shown). Referring to FIG. 1, the electrical terminals 20 are arranged in a plurality of rows in a longitudinal direction and staggeredly arranged with an adjacent row of said terminals 20 to save the space occupied by themselves.

When the electrical connector 1 is mating with a mating connector (not shown), the contact portions 21 are depressed downwardly by the mating connector. Meanwhile, the resilient portions 23 are resiliently compressed to provide a resilient force toward the contact portions 21.

As described above, each electrical terminal 20 has a pair of shoulder portions 22 symmetrically protruding from opposite edges of the contact portion 21 and a pair of mutually separated resilient portions 23 extending from the corresponding shoulder portions 22. Therefore, each contact portion 21 could receive a balanceable resilient force transferred from the pair of resilient portions 23 toward the pair of symmetrical shoulder portions 22. It is harder to have a displacement for each contact portion 22 because the resilient force provided to contact portions 22 is transferred from opposite directions.

Further more, each resilient portion 23 configured as three continuous compressible arc-like bent portions 231 is able to provide a resilient force superior than the force provided by a U-shaped resilient portion. Additionally, the pair of resilient portions 23 separated from each other and having the slot 242 defined therebelow would enjoy an adequate space to have a sufficient flexible deforming.

However, the disclosure is illustrative only, changes may be made in detail, especially in matter of shape, size, and arrangement of parts within the principles of the invention.

What is claimed is:

1. An electrical connector, comprising:

an insulative housing defining therein a plurality of passageways;

a plurality of electrical terminals retained in the passageways, each electrical terminal comprising a contact portion, a body portion, a tail portion extending downwardly from the body portion and a pair of resilient portions extending between the contact portion and the body portion, a pair of shoulder portions protruding from opposite sides of the contact portion and contacting with the insulative housing; and wherein said resilient portions extend downwardly from the corresponding shoulder portions.

2. The electrical connector as claimed in claim 1, wherein each resilient portion is configured as a wave shape and is formed with at least three continuous compressible, bent portions.

3. The electrical connector as claimed in claim 2, wherein said pair of wave-shaped resilient portions parallel extend along a same direction.

4. The electrical connector as claimed in claim 2, wherein said body portion defines thereon a slot to form a connect portion transversely extending therefrom and connecting with the resilient portions.

5. The electrical connector as claimed in claim 4, wherein said body portion has a plurality of barb portions formed along a side edge thereof.

6. An electrical connector comprising:

an insulative housing defining a plurality of passageways extending therethrough;

a plurality of contacts retainably disposed in the corresponding passageways, respectively;

each of said contact extending in a plane and defining a main base with an upper contacting portion and a lower soldering portion at two opposite sides, and a serpentine deflectable section positioned between the main base and the upper contacting portion, a through hole circumscribed by said deflectable section to provide deflection therewith under a condition that said deflectable section is not only downwardly compressible, in a vertical direction but also horizontally deflectable relative to a horizontal direction.

7. The electrical connector as claimed in claim 2, wherein said electrical terminals are arranged in a plurality of rows, and wherein each row of said terminals is staggeredly arranged with an adjacent row of said terminals.

8. The electrical connector as claimed in claim 7, wherein said insulative housing comprises a top wall defining a plurality of first slots communicating with corresponding passageways for extension of the contact portions of said terminals.

9. The electrical connector as claimed in claim 8, wherein said insulative housing comprises a bottom wall defining a plurality of second slots communicating with corresponding passageways for extension of the tail portions of said terminals.

10. The electrical connector as claimed in claim 1, wherein said insulative housing comprises a base portion, and a pair of side portions projecting laterally from opposite sides of the base portion and extending along a direction perpendicularly to said terminals.

11. The electrical connector as claimed in claim 10, wherein each side portion has a pair of protrusions, a recess defined between the protrusions, and a mounting hole communicating with said recess.

12. The electrical connector as claimed in claim 11, wherein each side portion has a post extending downwardly therefrom.

13. An electrical connector comprising:

an insulative housing defining a plurality of passageways extending therethrough;

a plurality of contacts retainably disposed in the corresponding passageways, respectively;

each of said contact extending in a plane and defining a main base with an upper contacting portion and a lower soldering portion at two opposite sides, and a serpentine deflectable section positioned between the main base and the upper contacting portion; wherein said serpentine deflectable section defines therein a through hole which is configured to comply with a contour of said serpentine deflectable section so as to form a pair of wavy resilient portions by two sides of said through hole.

14. The electrical connector as claimed in claim 13, wherein a bottom end of said serpentine deflectable section extends from the main base in a cantilever manner.

15. The electrical connector as claimed in claim 6, wherein a pair of wavy resilient portions are located by two sides of said through hole.

16. The electrical connector as claimed in claim 6, wherein said deflectable section defines a single point joint with said main base.

17. The electrical connector as claimed in claim 13, wherein said through hole is filly circumscribed in said serpentine deflectable section.

* * * * *